US005184022A

United States Patent [19]

Claar et al.

[11] Patent Number: 5,184,022

[45] Date of Patent: Feb. 2, 1993

[54] CENTRAL LOCKING SYSTEM AND SECURING DEVICE AND METHOD FOR CONTROLLING SAME

[75] Inventors: Klaus Claar, Gechingen; Hans Deischl, Jettingen; Martin Lindmayer, Böblingen; Jürgen Moczygemba, Lichtenstein; Jërgen Schrader, Stuttgart; Josef Schumacher, Reutlingen; Claus Töpfer; Peter Robitschko, both of Sindelfingen, all of Fed. Rep. of Germany

[73] Assignee: Mercedes-Benz AG, Stuttgart, Fed. Rep. of Germany

[21] Appl. No.: 658,678

[22] Filed: Feb. 21, 1991

[30] Foreign Application Priority Data

Feb. 27, 1990 [DE] Fed. Rep. of Germany ..... 4006122

[51] Int. Cl.[5] ..... E05B 65/20

[52] U.S. Cl. ..... 307/10.2; 70/237; 180/287

[58] Field of Search ..... 200/43.08, 11 C, 16, 200/573; 307/10.2; 361/172, 169.1; 180/287, 289; 70/237-239, 264, 279; 340/825.31

[56] References Cited

U.S. PATENT DOCUMENTS

| | | | |
|---|---|---|---|
| 3,887,029 | 6/1975 | Lischultz et al. | 307/10.2 X |
| 4,440,006 | 4/1984 | Kleefeldt | 70/264 |
| 4,519,227 | 5/1985 | Dumbser et al. | 70/264 |
| 4,858,060 | 8/1989 | Iwaoka et al. | 361/185 |
| 4,862,139 | 8/1989 | Fukamachi et al. | 340/426 |

FOREIGN PATENT DOCUMENTS

| | | |
|---|---|---|
| 2931136 | 2/1981 | Fed. Rep. of Germany . |
| 2811990 | 1/1984 | Fed. Rep. of Germany . |
| 3307542 | 1/1985 | Fed. Rep. of Germany . |
| 3516732 | 7/1986 | Fed. Rep. of Germany . |
| 3334049 | 11/1986 | Fed. Rep. of Germany . |
| 3703590 | 7/1988 | Fed. Rep. of Germany . |
| 3717778 | 12/1988 | Fed. Rep. of Germany . |
| 3804838 | 1/1989 | Fed. Rep. of Germany . |
| 3513555 | 4/1989 | Fed. Rep. of Germany . |
| 3827564 | 5/1989 | Fed. Rep. of Germany . |
| 2193589 | 2/1988 | United Kingdom . |

*Primary Examiner*—A. D. Pellinen
*Assistant Examiner*—David Osborn
*Attorney, Agent, or Firm*—Evenson, Wands, Edwards, Lenahan & McKeown

[57] ABSTRACT

A method and device for the electrical control of a central locking system and of a mechanical securing device (that provides additional lock protection) for motor vehicles by a lock cylinder that interacts with at least two control switches. This method and device ensures a better utilization of the electrical control switches, in that, an unlocking control switch assigned to the unlocking of the central locking system and the deactivation of the mechanical securing device is switched in addition to a locking control switch assigned to the locking of the central locking system. If the lock cylinder is pivoted in the locking direction beyond its regular locking position, the resultant joint switching state of the two switching control devices is evaluated to activate the mechanical securing device.

16 Claims, 4 Drawing Sheets

CENTRAL LOCKING SYSTEM AND SECURING DEVICE AND METHOD FOR CONTROLLING SAME

BACKGROUND AND SUMMARY OF THE INVENTION

The present invention relates to a method and apparatus for electrically controlling a central locking system and a securing device for motor vehicles which have at least one lock cylinder with at least two associated control switches. For the electrical control of the unlocking or locking of the central locking system and the disabling or enabling of the securing device, the lock cylinder is pivotable by means of a key out of a neutral position in an unlocking direction or oppositely in a locking direction and at least beyond a regular locking position by further pivoting in the locking direction into a securing position for enabling the securing device. A securing device is provided for additional mechanical blocking of locked closures that is enabled and disabled by means of signals generated by the two control switches.

A central locking system and securing device of the above type is known from German Patent Document DE 3,513,555 C2. To control an additional securing or blocking device for the actuating elements of a central locking system by means of a lock cylinder, there is a first microswitch for enabling and a second microswitch for disabling the blocking of the actuating-element assigned to the lock cylinder. In a known way, this blocking mechanically prevents a secured vehicle from being opened from inside after a window pane has been knocked out. A third microswitch is assigned to the lock cylinder for controlling the central locking system, although this control itself is not described in more detail in the above-referenced Patent Document.

A lockable actuating element which can be used in a device of the relevant generic type is known from German Patent Document DE 3,804,838 C1. In particular, even when the additional safeguard is enabled, this actuating element makes it possible to carry out the purely mechanical release of the closure assigned to it and consequently to use the vehicle even in the event of a possible failure of the vehicle battery voltage necessary for disabling the securing device.

In modern motor vehicle construction, the lock cylinders of the mechanical closing system are allowed less and less constructional space in the doors. This results in proposals for shifting control microswitches out of the immediate vicinity of the lock cylinder towards a follower rotationally coupled to the lock cylinder. (German Patent Documents DE 3,717,778 A1, DE 3,827,564 C1).

With this in view, both lock cylinder constructions mentioned immediately above involve a high outlay and a number of electrical control switches. It is known from German Patent Document DE 3,307,542 C2 to control both a central locking system and an additional theft security system by means of an axially split lock cylinder, two electrical control switches being switched simultaneously in the lock cylinder when a special security key is used. In this reference, the two control switches are designed as bistable change-over switches, each with three terminals, and one of the switches is intended solely for controlling the central locking system and the other solely for controlling the theft security system. Moreover, there also has to be a priority control involving a high outlay which ensures the correct time sequence of the individual locking operations (that is to say, first "lock" and then "secure" or first "desecure" and then "unlock").

Finally, it is known from German Patent Document DE 3,516,732 C1 to control a burglar/anti-theft warning system in a motor vehicle via a control switch of the central locking system of the vehicle. When a master key or security key is used in the lock cylinder, a lock-cylinder switch activates a switching device which also causes switch signals of the control switch to be fed to the control unit of the burglar/anti-theft warning system.

An object of the invention is to provide a process by which, with the operating sequence being constant, there is a better utilization of existing electrical switching means of a locking and securing device. It is also an object to provide for the electrical control of a locking and securing device for motor vehicles in such a way that, while the simple switch design is preserved, it is possible, with a constant operating sequence, to use fewer electrical switches.

This and other objects are achieved by the present invention which provides a method for electrically controlling a central locking system and a securing device for motor vehicles which have at least one lock cylinder with at least two associated control switches. For the electrical control of the unlocking or locking of the central locking system and the disabling or enabling of the securing device, the lock cylinder is pivotable by means of a key out of a neutral position in an unlocking direction or oppositely in a locking direction and at least beyond a regular locking position by further pivoting in the locking direction into a securing position for enabling the securing device. A securing device is provided for additional mechanical blocking of locked closures that is enabled and disabled by means of signals generated by the two control switches. The method of the present invention comprises the steps of controlling the central locking system in the unlocking or locking directions by actuating one of the associated control switches, and successively actuating the two control switches during the pivoting of the lock cylinder into the securing position and simultaneously switching the two control switches into a joint switching state immediately following the successive actuation of the two control switches during the pivoting of the lock cylinder into the securing position. The joint switching state for enabling the securing device is evaluated and the securing device is disabled by actuating the control switch that is actuated during the pivoting of the lock cylinder in the unlocking direction.

By means of two simple touch-contact switches, at least three different positive signal states, that are distinguishable from the non-actuated state of rest without setting at a specific electrical potential, can be produced. These signal states are: 1) first switch closed, second switch open; 2) first switch open, second switch closed; and 3) both switches closed at the same time.

The switching states of the two switches can in each case be evaluated both individually and jointly in AND operation.

According to the invention, state 3) is obtained in that, during the further pivoting of the lock cylinder beyond the regular locking position into a securing position in which the locking control switch is closed, the unlocking control switch is also additionally closed.

State 3) can also be obtained in that, during the further pivoting of the lock cylinder beyond the regular unlocking position into a desecuring position in which the unlocking control switch is closed, the locking control switch is also additionally closed.

In an embodiment of the present invention, the central locking system is controlled in the unlocking and the locking direction by means of the switching states 1) and 2) respectively, and the securing device is connected by means of the switching state 3). In this procedure, the sequence "first lock, then secure" is also directly maintained, because by means of the individual signal from the locking control switch the central locking system is already activated in the locking direction, and only thereafter, when the simultaneous activation of the unlocking control switch occurs, can the securing device be activated in the securing direction. There is no need in this case for a special "desecuring position", because, in a manner known per se (German Patent Document DE 3,334,049 C2), the securing device can be disconnected again by a simple "unlock" control signal from the unlocking control switch (with the rotation of the key in the unlocking direction). Here too, of course, internal signal processing guarantees the necessary priority.

It is known from German Patent Document DE 3,703,590 C1 to control a central locking system by means of simple touch-contact change-over devices with a middle position, the same electrical potential being applicable to two different inputs (locking and unlocking input) of a control unit by means of the touch-contact change-over devices. In principle, the touch-contact change-over devices used there could each be replaced in an equivalent manner by two individual touch-contact switches, but the above-mentioned patent document gives no indication as to the simultaneous actuation of the two touch-contact switches which are provided per se for activating a central locking system in different operating directions for the control of a mechanical securing device.

In another embodiment of the method of the present invention, the switching state 3), in which the two control switches are actuated simultaneously after switching, is advantageously evaluated for generating different switching effects by taking into account the switching sequence of the control switches. With simple electrical or electronic switching means, it is possible to enable the mechanical securing device if the control switch used for the locking control is actuated first and then the control switch used for the unlocking control and both also remain actuated at the same time. To this extent, the arrangement corresponds to that already described. Conversely, however, the mechanical securing device can be disabled only when the control switch used for the unlocking control is actuated first and then the control switch used for the locking control and both also remain actuated at the same time.

In this case, of course, the time sequence "first desecure, then unlock" is ensured again, and this can be obtained, for example, in that, when the securing device is connected, a simple unlocking control signal from the unlocking control switch is not processed as a result of electrical suppression. The particular switching state of the securing device can directly, in a known manner, be stored in a central control unit and called up.

Other objects, advantages and novel features of the present invention will become apparent from the following detailed description of the invention when considered in conjunction with the accompanying drawings.

DETAILED DESCRIPTION OF THE DRAWINGS

Figure 1:
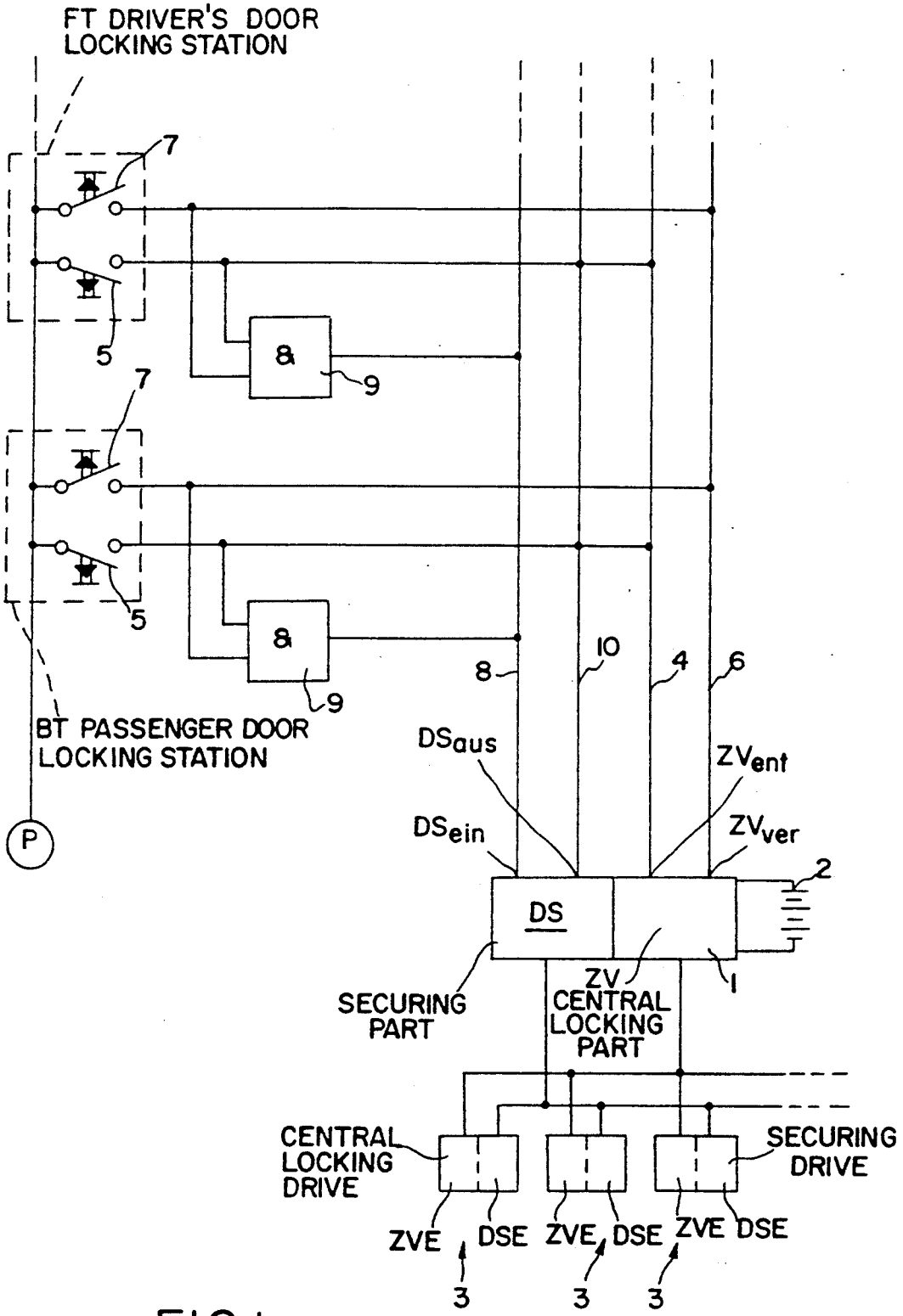
FIG. 1 shows an electrical switch diagram of a central locking system and securing device according to an embodiment of the present invention.

In the circuit diagram of FIG. 1, a central control circuit 1 is subdivided into a central locking part ZV and a securing part DS which are both connected to a voltage source 2. The central control circuit 1 controls actuating elements 3 which themselves each have a central locking drive ZVE and a securing drive DSE, the central locking drive ZVE being activatable by the central locking part ZV and the drive DSE being activatable by the securing part DS of the central control circuit 1. There is no need to discuss the exact functioning of these part arrangements in more detail here, since, as already mentioned, known systems of these part arrangements are in the prior art. The central locking part ZV and the drives ZVE together form the central locking system, while the securing device is formed by the securing part DS and the drives DSE. The drives ZVE and DSE, shown only diagrammatically, can be operated electromagnetically, electromotively or pneumatically in a known way.

First (unlocking) control switches 5 are connected via a control line 4 to an unlocking control input $ZV_{unlock}$ of the central locking part ZV and second (locking) control switches 7 are connected via a control line 6 to a locking control input $ZV_{lock}$, the constructional arrangement and the design of these switches being described later. It shall merely be mentioned, in the first place, that a pair of switches comprising an unlocking control switch 5 and a locking control switch 7 is assigned respectively to a locking station FT in the driver's door and BT in the front-seat passenger's door, while further locking stations can be connected electrically in the same way. Furthermore, all the control switches 5, 7 are of the same electrical potential P in relation to the central control circuit 1 or its inputs.

A control line 8, to which outputs of AND elements 9 are connected, leads to a securing control input $DS_{on}$ of the securing part DS.

The control switches 5 and 7 of a particular locking station are connected to the two inputs of one of the AND elements 9, so that an output signal from one of the AND elements 9 and therefore a signal on the control line 8 and at the securing control input $DS_{on}$ is obtained only when both the control switches 5 and 7 are switched simultaneously. According to the present invention, this signal is used for enabling or activating the mechanical securing device or actuating-element blocking. To simplify FIG. 1, the representation of voltage supplies of the logic gates and possibly necessary inverters, etc. has been omitted.

The unlocking control switches 5 of the various locking stations are connected to a control line 10 which is connected to a desecuring control input $DS_{off}$ of the securing part DS. In the illustrated embodiment of FIG. 1, after an individually occurring signal or switching operation of one of these control switches 5, first, if appropriate, the connected securing device DS/DSE is disconnected and thereafter the central locking system ZV/ZVE is activated in the unlocking direction.

The continuation of the control lines 4, 6, 8 and 10 which is represented by broken lines illustrates that, in principle, any number of locking stations or pairs of control switches can be connected.

However, it is also possible in certain embodiments, that although a multi-point mode of operation (i.e. control switches at a plurality of locking stations) is provided for the central locking system ZV/ZVE, nevertheless the control of the securing device is possible only from a single locking station, preferably the driver's door locking station FT. In this case, all the direct or indirect connections of the control switches 5 and 7 of the locking station BT to the control lines 8 and 10 would be omitted.

Figure 2:
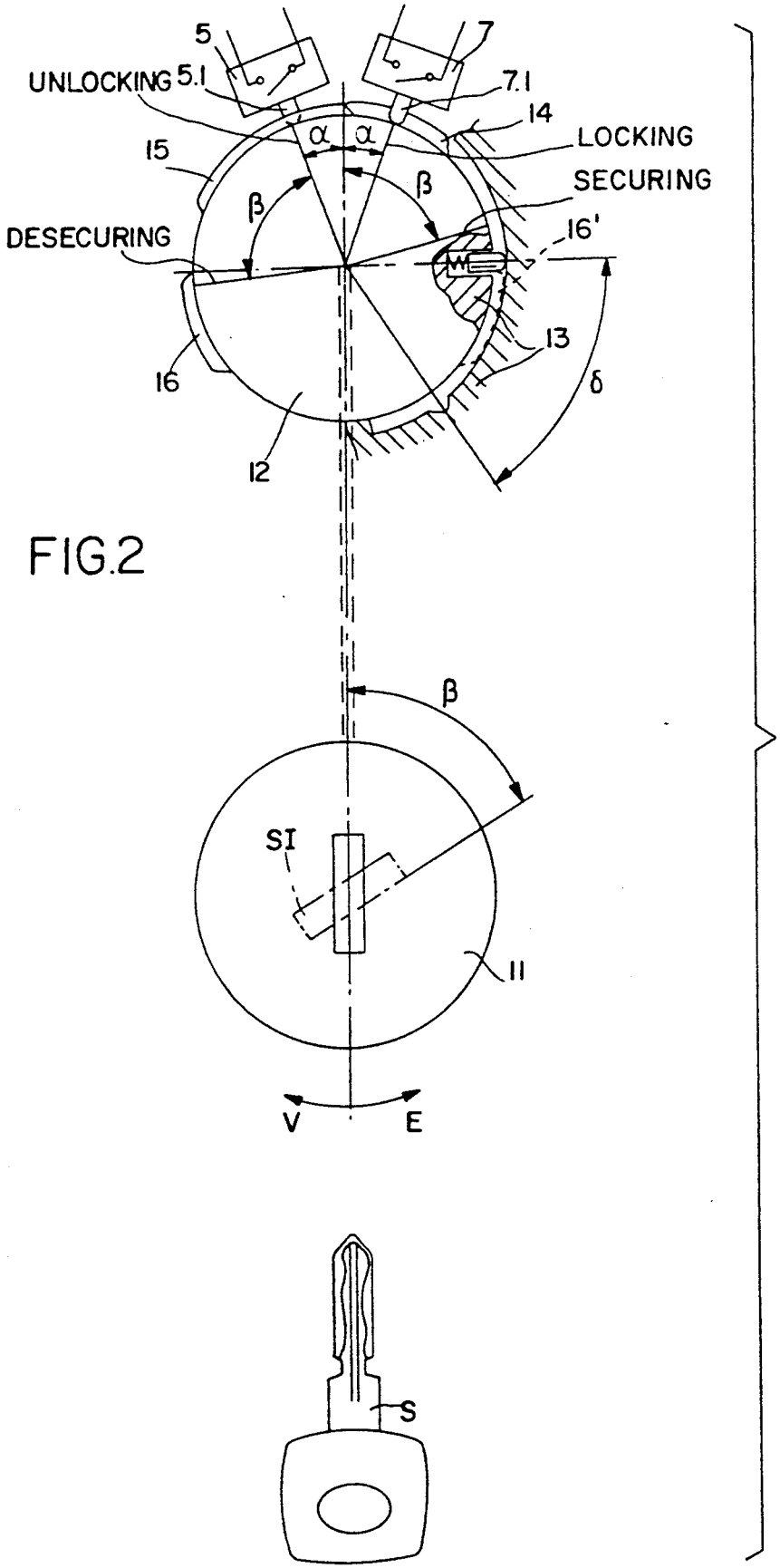
FIG. 2 shows a diagrammatic view of a lock cylinder and a follower with a representation of the pivoting ranges or pivoting angles and of the control switches and their switch cams.

An embodiment of the control switches 5 and 7 at a locking station is shown in FIG. 2. A lock cylinder 11 is pivotable by means of a key S out of a neutral middle or key withdrawal position shown, in the locking or securing direction (arrow V, clockwise direction), and in the opposite unlocking or desecuring direction (arrow E, counterclockwise direction). On a follower 12 which, as indicated by a broken double line, is connected fixedly in terms of rotation to the lock cylinder 11, there is, on the one hand, an action-point device 13, shown in simplified form, which, at a pivoting angle of approximately 55° in the securing direction, opposes a noticeable mechanical resistance to further pivoting. This mechanical resistance is desirable in order to give the vehicle user tactile information that he is enabling the securing state of his vehicle.

The follower 12 is assigned, adjacent to one another in space, two control switches 5 and 7 that are touch-contact switches of the micro type with switch tappets 5.1 and 7.1. For actuating these control switches 5 and 7, the follower 12 has various switch cams corresponding to the switch tappets.

The exemplary arrangement shown in FIG. 2 was chosen in view of size ratios and relative positions with the purpose of illustrating the position of the switching angles at which the control switches 5 and 7 are actuated or connected during the pivoting of the lock cylinder 11 and is therefore not true to scale. The indicated switch tappets 5.1 and 7.1 of the control switches 5, 7 are in different planes which are themselves parallel to the drawing plane, and the corresponding switch cams are likewise in correspondingly different planes on the circumference of the follower 12.

The first switch cam 14 actuates the control switch 5 during the pivoting of the lock cylinder 11 in the counterclockwise direction, and its switching angle $\alpha$ defining the regular unlocking position of the lock cylinder 11 is at approximately 20°. The second switch cam 15 actuates the control switch 7 during the pivoting of the lock cylinder 11 in the clockwise direction, and its switching angle $\alpha$ defining the regular locking position of the lock cylinder 11 is likewise at approximately 20°. The switch cam 15 is so extensive that the control switch 7 remains switched when the lock cylinder 11 is pivoted in the same direction beyond the regular locking position (angle $\alpha$) further beyond the pressure point at $\delta=55°$ into the securing position SI which is indicated on the lock cylinder and the keyhole and which is defined by a switching angle $\beta$ of approximately 75°.

In this securing position, a third switch cam 16 actuates the control switch 5, and this time its switching angle is at $\beta$=approximately 75°, here in the clockwise direction. Because the control switch 7 also remains switched at the same time, as mentioned, this produces a joint switching state which can be evaluated for connecting the securing device DS/DSE, as already described in conjunction with FIG. 1. All the particulars of switching angles relate to the neutral key withdrawal position.

The associated closure and the connection of the follower 12 to its mechanical linkage are not shown for the sake of clarity. The lock arrangement corresponds to the state of the art and therefore needs not be described in more detail. It is of no importance per se for the functioning of the device at which location of the locking station mechanism between the lock cylinder and follower the control switches, switch cams and pressure-point device are arranged. Only the constructively predetermined geometrical data of the individual vehicle type or of the closure are criteria for the local accommodation of the individual components.

Figure 3A:
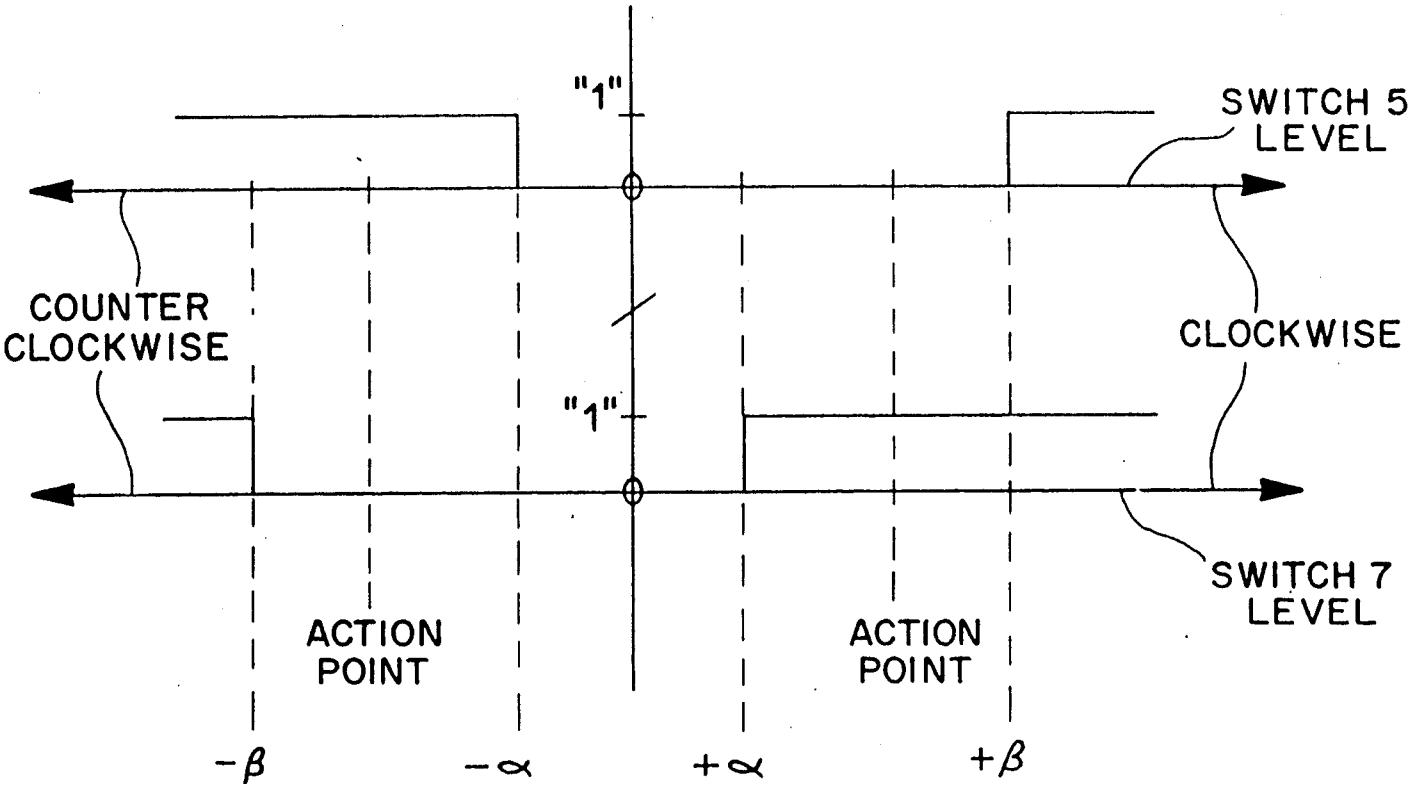
FIG. 3*a* shows a diagram representing the switching angles of the respective control switches and the respective sequence of their actuation.
Figure 3:
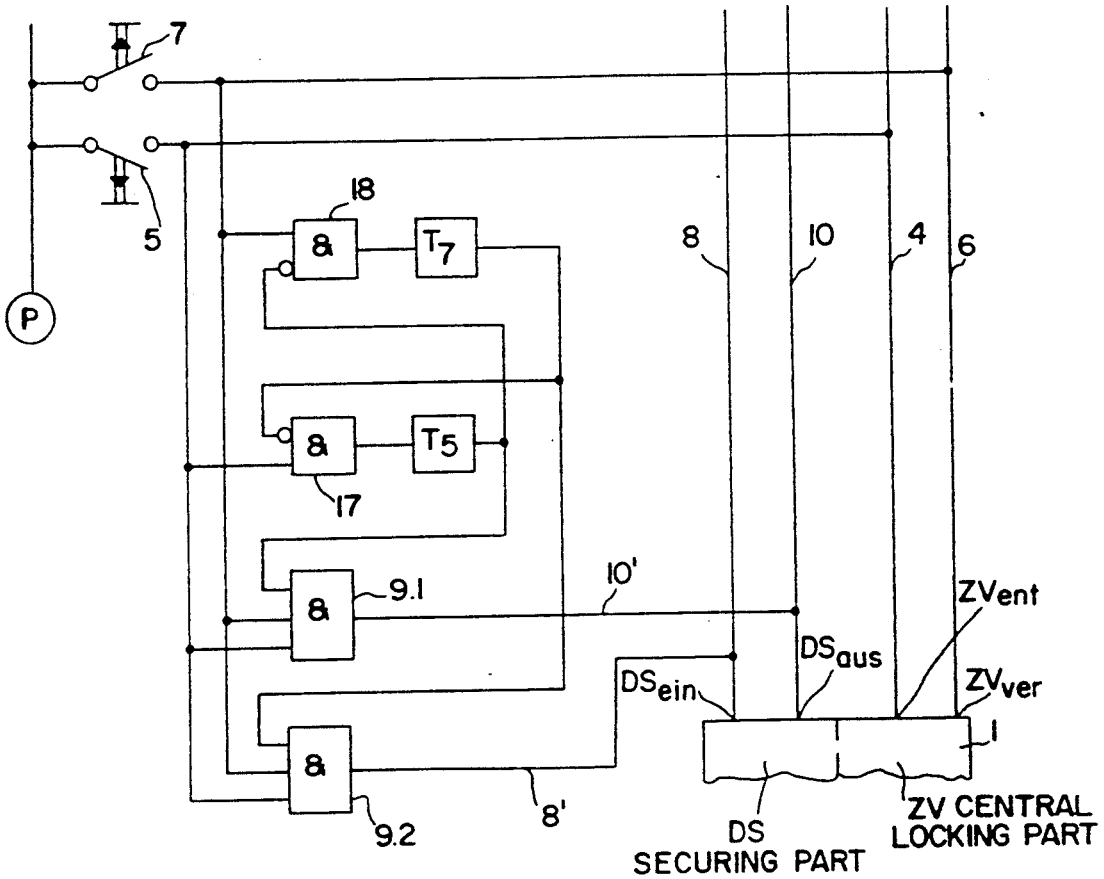
FIG. 3 shows another embodiment of the switch diagram of FIG. 1, by which an evaluation of the switching sequence of the control switches with the result of different switching effects is possible.

FIG. 3 shows a simple exemplary circuit, by means of the logic gates of which the joint switching state of the two control switches 5 and 7 can also be evaluated after the switching sequence of the two switches for generating different effects, as already described.

Initially, for this, it is necessary that the lock cylinder 11 be additionally pivotable in a known way in the unlocking direction beyond the regular unlocking position into a desecuring position, with first the unlocking control switch 5 being switched and then, in the desecuring position the locking control switch 7 being switched. This is the reverse of the operation already described in conjunction with FIG. 2. The operation according to FIG. 2 is maintained in this embodiment during the pivoting of the lock cylinder 11 in the locking direction. The mechanical arrangement corresponds essentially to that shown in FIG. 2, and a switch cam 16' (represented by broken lines in FIG. 2) corresponding to the switch cam 16 also has to be added for actuating the locking control switch 7 during the pivoting of the lock cylinder 11 in the unlocking direction into the desecuring position. Furthermore, the switch cam 14 must be extended so that the control switch 5 too is also switched in the added desecuring position.

Of course, it is not absolutely necessary per se to extend the switch cams 14 and 15 in the way described, since it is also possible to form a special switch cam onto the follower 12 for each switching point ($\alpha$ or $\beta$) of the switches 5, 7, making sure, of course, that the switching sequence to be evaluated is maintained. It is also possible, of course, to make it necessary to overcome a mechanical resistance between the regular unlocking position and the desecuring position.

In FIG. 3*a*, which shows a diagrammatical view of the switching angles of the respective control switches 5 and 7, there is a vertical axis representing the neutral key withdrawal position of lock cylinder 11. An upper horizontal axis represents the control switch 5 and a lower horizontal axis represents the control switch 7. The respective switch states of the touch switches are only represented by logical "0" (rest state) and "1" (actuated state).

Following the respective horizontal axes to the right, where angles $\alpha$ and $\beta$ are positive, corresponds to pivoting the lock cylinder 11 clockwise, i.e. in the locking direction. Correspondingly, following the horizontal axes to the left corresponds to pivoting the lock cylinder 11 counterclockwise, i.e. in the unlocking direction, where angles $\alpha$ and $\beta$ are negative.

As can easily be seen, at a rotation angle $+\alpha$ of the lock cylinder 11 only switch 7 is actuated to level "1". It remains actuated during further rotation, which passes first an action point angle and then comes to an angle $+\beta$, where additionally the control switch 5 is actuated to its level "1", thus producing a first joint switching state as mentioned above. Angle $+\alpha$ corresponds to the regular locking position, while angle $+\beta$ corresponds to the securing position SI as set out previously.

At an opposite rotation angle $-\alpha$ only control switch 5 is actuated, according to the regular unlocking position of lock cylinder 11. After passing another action point angle, at an angle $-\beta$, which corresponds to the desecuring position of lock cylinder 11, control switch 7 is also actuated, thus producing a second joint switching state.

Distinction between the two joint switching states (clockwise and counterclockwise or "securing" and "desecuring") can easily be made by evaluating the sequence of actuation, which depends on the pivoting direction of the locking cylinder 11, of the respective control switches, this evaluation proceeding as described below.

Starting from the switch diagram according to FIG. 1, the reference symbols of which have been preserved for identical components, in FIG. 3 there are two AND gates 9.1 and 9.2, each with three inputs, one input of these AND gates being connected respectively to the control switch 5 and a second input of these AND gates being connected to the control switch 7.

The output of the AND gate 9.1 is connected via a line 10' to the control line 10 to the desecuring control input $DS_{off}$, and the output of the AND gate 9.2 is connected via a line 8' to the control line 8 to the securing control input $DS_{on}$.

Two timing elements $T_5$ and $T_7$ are also provided, $T_5$ being activatableby the control switch 5 via an AND gate 17, and $T_7$ being activatable by the control switch 7 via an AND gate 18. The two timing elements $T_5$ and $T_7$ have the same function and time constants.

The timing elements $T_5$, $T_7$ are electrically interlocked in that an output signal from the timing element $T_7$ is fed to an inverting input of the AND gate 17 in front of the timing element $T_5$ and an output signal from the timing element $T_5$ is fed to an inverting input of the AND gate 18 before the timing element $T_7$. A starting of one of the timing elements $T_5$, $T_7$ is therefore impossible while the time constant of the other particular timing element first started is running.

Furthermore, the output signal from the timing element $T_5$ is fed to a third input of the AND gate 9.1, and the output signal from the timing element $T_7$ is fed to a third input of the AND gate 9.2.

As a result of this arrangement, the circuit functions are as follows. During the pivoting of the lock cylinder 11 in the locking direction, the control switch 7 is switched first. This transmits, in addition to a locking control signal via the line 6, a starting pulse via the AND gate 18 to the timing element $T_7$ which thereupon blocks the AND gate 17 via its inverting input.

However, two inputs are already logical "1" at the AND gate 9.2, so that during the subsequent switching of the control switch 5, with the lock cylinder 11 in the securing position, an output signal from the AND gate 9.2 is transmitted to the control line 8 via the line 8' and the securing device DS is enabled.

During the pivoting of the lock cylinder 11 in the unlocking direction, the control switch 5 is switched first. This transmits, in addition to an unlocking control signal via the line 4, a starting pulse via the AND gate 17 to the timing element $T_5$ which thereupon blocks the AND gate 18 via its inverting input.

Two inputs are then already logical "1" at the AND gate 9.1, so that during the subsequent switching of the control switch 7, with the lock cylinder 11 in the desecuring position, an output signal from the AND gate 9.1 is transmitted to the control line 10 via the line 10' and the securing device is disabled.

In the central control circuit the priority "first desecure, then unlock" is ensured internally. This can be carried out, for example, by a logical linkage of a "securing device connected" signal with the signal from the control switch 5 fed via the line 4, the signal from the control switch 5 being stored, but its switching effect being suppressed until the "securing device connected" signal is no longer present.

The central control circuit 1 can also comprise the logical gates or timing elements here arranged outside for the purposes of graphical representation.

In principle, the logical functions of the AND gates 17 and 18 could also be performed by relays with break contacts which would themselves have to be controllable by the timing elements $T_5$ and $T_7$.

Figure 4:
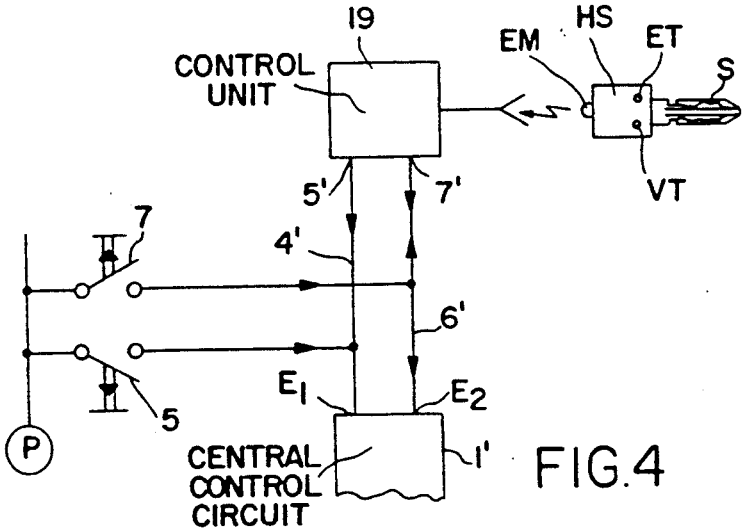
FIG. 4 shows an embodiment of the device according to the present invention which also makes it possible to use a remote-control hand code transmitter for the exclusive control of the central locking system.

For the sake of clarity, FIGS. 1 and 3 show the control inputs for the central locking system and securing device separately. In contrast, FIG. 4 shows a central control circuit 1' with only two inputs $E_1$ and $E_2$, to which the control switches 5 and 7 are connected directly via control lines 4' and 6'. In this Figure, the logical gates or timing elements and their interconnections which are shown in FIGS. 1 and 3 are internal parts of the central control circuit 1'. Of course, this also contains internally the division, shown in FIGS. 1 and 3, into control lines 4 and 6 or 8 and 10.

In addition, outputs 5' and 7' of a control unit 19 (code comparator, amplifier, etc.) of an infrared remote-control device are also connected to the control lines 4' and 6'. The two outputs 5' and 7' of the control unit 19 are electrically interlocked internally, so that the securing device, which of course can be enabled only when signals from both control switches are applied simultaneously to the control lines 4' and 6', cannot be enabled via the remote control.

For the remote control, there is a hand transmitter HS with an emitter EM, an unlocking button ET and a locking button VT, which is combined in a known way with the mechanical key S.

The electrical control functions would be the same as those described with respect to FIG. 1. In this configuration, it could happen that a vehicle user wants merely to lock his vehicle with the key S, yet not secure it, but, while turning the key in the locking direction, also inadvertently actuates one of the buttons ET or VT of the hand transmitter.

In such an accidental combination of circumstances, to prevent the securing device from being enabled against the wishes of the vehicle user, the lines 4' and 6' can be used at least in portions in two directions ("bidirectionally"), as indicated by small arrows in both directions in the portion between the control unit 19 and the electrical coupling of the control switches 5 and 7. Thus, a transmission of signals from the control switches 5 and 7 to the control unit 19 and their reception and processing in this are also possible. For this purpose, the control unit 19 possesses a blocking circuit 21 which, when a signal from one or both of the control switches 5 and/or 7 is applied to one or both of the outputs 5' and 7', suppresses at least the effect of a control signal from the infrared remote-control device via the line 4' or 6'.

This effect suppression or blocking circuit 21 can be obtained directly by means of an internal logical linkage between the control signal of the infrared remote-control device with a signal from the control switches 5 and 7, the control signal being transmitted to the central control circuit 1 only when no signal from one of the control switches 5, 7 is present ("AND NOT" operation).

Although the invention has been described and illustrated in detail, it is to be clearly understood that the same is by way of illustration and example, and is not to be taken by way of limitation. The spirit and scope of the present invention are to be limited only by the terms of the appended claims.

What is claimed:

1. Method for electrically controlling a central locking system and a securing device for motor vehicles which have at least one lock cylinder with at least two associated control switches, wherein for the electrical control of the unlocking or locking of the central locking system and the disabling or enabling of the securing device, the lock cylinder is pivotable by means of a key out of a neutral position in an unlocking direction or oppositely in a locking direction and at least beyond a regular locking position by further pivoting in the locking direction into a securing position for enabling the securing device, said securing device providing for additional mechanical blocking of locked closures by being enabled and disabled by means of signals generated by the two control switches, the method comprising:

controlling the central locking system respectively in the unlocking direction by actuating an unlocking one of the associated control switches and in the locking direction by actuating a locking one of the associated control switches;

successively actuating the two control switches during the pivoting of the lock cylinder into the securing position wherein the two control switches are in a joint switching state immediately following the successive actuation of the two control switches during the pivoting of the lock cylinder into the securing position;

evaluating the joint switching state for enabling the securing device;

disabling the securing device by actuating the unlocking one of the associated switches.

2. Method for electrically controlling a central locking system and a securing device for motor vehicles which have at least one lock cylinder with at least two associated control switches, wherein for the electrical control of the unlocking or locking of the central locking system and the disabling or enabling of the securing device, the lock cylinder is pivotable by means of a key out of a neutral position in an unlocking direction or oppositely in a locking direction and at least beyond a regular locking position by further pivoting in the locking direction into a securing position for enabling the securing device, said securing device providing for additional mechanical blocking of locked closures by being enabled and disabled by means of signals generated by the two control switches, the lock cylinder also being pivotable in the unlocking direction beyond a regular unlocking position by further pivoting in the unlocking direction into a desecuring position, the method comprising:

controlling the central locking system in the unlocking and opposite locking directions by respectively actuating one or the other of the associated control switches, successively actuating the two control switches during the pivoting of the lock cylinder into the securing position and during the pivoting of the lock cylinder into the desecuring position in a sequence dependent on the pivoting direction and the simultaneous switching of the two control switches into a joint switching state immediately following the respective actuation of the control switches in these positions;

evaluating the differing switching sequences in which, during the pivoting of the lock cylinder into the securing position or the desecuring position, the two control switches are actuated, enabling the securing device when first the control switch used for the locking control and then the control switch used for the unlocking control are actuated and both also remain actuated at the same time;

disabling the securing device when first the control switched used for the unlocking control and then the control switch used for the locking control are actuated and both also remain actuated at the same time, with first the securing device being disconnected and then the central locking system being unlocked.

3. A central locking system and securing device for motor vehicles, comprising:

at least one locking station with a lock cylinder for mechanically unlocking and locking a closure as a result of a key rotation starting from a neutral key withdrawal position and rotating in an unlocking or opposite locking direction, said lock cylinder being pivotable in the locking direction by means of the key at least into a securing position obtainable beyond a regular locking position in the locking direction;

first and second electrical control switches assigned to said locking station, the first control switch being switchable at least during the key rotation in the unlocking direction and the second control switch being switchable at least during key rotation in the locking direction by means of the pivoted lock cylinder;

a central locking system having actuating elements for the unlocking or locking of further closures, wherein the first control switch controls the central locking system in the unlocking direction and the second control switch controls the central locking system in the unlocking direction;

a central control circuit electrically controllable from the lock cylinder indirectly by at least one of the first and second control switches, said central control circuit controlling the central locking system, the securing device being enabled and disabled by means of the central control circuit after being activated by switching signals from the first and second control switches, said securing device comprising actuating elements for additional mechanical blocking of the centrally locked closures;

actuating means for switching the first control switch during the pivoting of the lock cylinder into the securing position such that at least in the securing position, the first and second control switches are jointly actuated;

switching elements for combining signals from the first and second control switches; and means for evaluating the joint switching state occurring as a result of the jointly applied signals of the control switches for activating the securing device in the securing direction.

4. Device according to claim 3, wherein the actuating means includes switch cams mechanically connected fixedly in terms of rotation to the lock cylinder and actuating the first and second control switches, the switch cams including a first switch cam for actuating the first control switch and arranged such that said first control switch is switched by said first switch cam in the securing position of the lock cylinder, in addition to the second control switch already previously switched by a second switch cam.

5. Device according to claim 4, wherein the means for evaluating include at least one logical gate for combining switching signals from the first and second control switches, the logical gate having an output which is connected to an input of the central control circuit for connecting the securing device.

6. Device according to claim 4, further comprising an action-point device assigned to the lock cylinder which provides a noticeable mechanical resistance that is overcome between the regular locking position and the securing position when moving the lock cylinder into the securing position.

7. Device according to claim 4, wherein the actuating means further includes a follower having an outer circumference, said follower being rotationally coupled to the lock cylinder and the switch cams being arranged on said outer circumference, and wherein the first and second control switches are arranged in the immediate vicinity of the follower.

8. Device according to claim 3, further comprising:

a control unit coupled to the central control circuit and having a receiver, by means of which at least the central locking system is also controllable via wirelessly and contactlessly transmittable code signals of an electronic key, the control unit having two outputs coupled via two control lines to one of the first and second control switches, said one of the first and second control switches being connected respectively for control-signal transmission, and means for electrically suppressing an output signal of the control unit when a signal from one of the first and second control switches is applied to the outputs of the control unit via the control lines.

9. Device according to claim 8, wherein the means for electrically suppressing the output signal of the control unit is responsive to a result of the internal logical linking of the control signal of the control unit with each signal from the first and second control switches, the control signal from the control unit being transmitted to the central control circuit only when no signal from one of the first and second control switches is present.

10. Central locking system and securing device for motor vehicles, comprising:

at least one locking station with a lock cylinder for the mechanical unlocking and locking of a door closure as a result of a key rotation starting from a neutral key withdrawal position and rotating in an unlocking or opposite locking directions, said lock cylinder being pivotable by means of the key into a securing position obtainable by rotation beyond a regular locking position in the locking direction and into a desecuring position obtainable by rotation beyond a regular unlocking position in the unlocking direction;

first and second electrical control switches assigned to said locking station, the first control switch being switchable at least during the key rotation in the unlocking direction and the second being switchable at least during the key rotation in the opposite locking direction by means of the pivoted lock cylinder;

a central control circuit electrically controllable from the lock cylinder indirectly by at least one of the first and second control switches, said central control circuit controlling the central locking system, the securing device being enabled and disabled by means of the central control circuit after being activated by switching signals from the first and second control switches, said securing device comprising actuating elements for additional mechanical blocking of the centrally locked closures;

a central locking system having actuating elements for the unlocking or locking of further closures, wherein the first control switch controls the central locking system in the unlocking direction and the second control switch controls the central locking system in the locking direction;

first actuating means for switching the first control switch during the pivoting of the lock cylinder into the securing position such that in the securing position, the first and second control switches are jointly actuated;

switching elements for combining signals from the first and second control switches;

second actuating means for switching the second control switch during the pivoting of the lock cylinder into the desecuring position such that in the desecuring position, the first and second control switches are jointly actuated, a sequence circuit for evaluating the respective switching sequence of the first and second control switches; and means for causing evaluation of the joint switching state to occur as a result of the simultaneously applied signals of the control switches and for connecting or disconnecting the securing device as a function of the respective switching sequence of the first and second control switches.

11. Device according to claim 10, wherein the sequence circuit includes:

a first timing element coupled to the first control switch and which is started as a result of the actuation of the first control switch and has a first output of the sequence circuit;

a second timing element coupled to the second control switch and which is started as a result of the actuation of the second control switch and has a second output of the sequence circuit; and a blocking member coupled to follow each of the timing elements for preventing a simultaneous starting of the first and second timing elements.

12. Device according to claim 11, wherein the means for causing evaluation includes:

a first logical AND gate having an output coupled to a desecuring control input of the central control circuit and a first input of coupled to the first control switch, a second input coupled to the second control switch and a third input coupled to a first output of the sequence circuit; and a second logical AND gate having an output coupled to a securing control input of the central control circuit and a first input coupled to the first control switch, a second input coupled to the second control switch and a third input coupled to a second output of the sequence circuit.

13. Device according to claim 10, further comprising spring-detent action-point devices assigned respectively to the lock cylinder, said action-point devices allowing the lock cylinder to be rotated into the securing position or into the desecuring position by overcoming a noticeable mechanical resistance between the regular locking position and the securing position or between the regular unlocking position and the desecuring position, respectively.

14. Device according to claim 10, wherein the actuator means includes switch cams mechanically connected fixedly in terms of rotation to the lock cylinder and for actuating the control switches, said switch cams being arranged on the outer circumference of a follower rotationally coupled to the lock cylinder, and wherein the control switches are arranged in the immediate vicinity of the follower.

15. Device according to claim 10, further comprising:

a control unit coupled to the central control circuit and having a receiver, by means of which at least the central locking system is also controllable via wirelessly and contactlessly transmittable code signals of an electronic key, the control unit having two outputs coupled via two control lines to one of the first and second control switches, said one of the first and second control switches being connected respectively for control-signal transmission, and means for electrically suppressing an output signal of the control unit when a signal from one of the first and second control switches is applied to the outputs of the control unit via the control lines.

16. Device according to claim 15, wherein the means for electrically suppressing the output signal of the control unit is responsive to a result of the internal logical linking of the control signal of the control unit with each signal from the first and second control switches, the control signal from the control unit being transmitted to the central control circuit only when no signal from one of the first and second control switches is present.

* * * * *